US006557987B1

(12) United States Patent
Shibata et al.

(10) Patent No.: US 6,557,987 B1
(45) Date of Patent: May 6, 2003

(54) CO-EXTRUDED TUBING FOR AN OFF-AXIS INK DELIVERY SYSTEM

(75) Inventors: Alan Shibata, Camas, WA (US); Alan Biggs, Vancouver, WA (US); Lap Thai Nguyen, Vancouver, WA (US); John Michael Kniffin, Wilsonville, OR (US); Paul L. Nash, Monmouth, OR (US); Yi Liu, Corvallis, OR (US); Gerald A. Mello, Albany, OR (US); Ah Chong Johnny Tee, Singapore (SG); Timothy A. Longust, Vancouver, WA (US); Justin M. Roman, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 199 days.

(21) Appl. No.: 09/669,620

(22) Filed: Sep. 25, 2000

(51) Int. Cl.[7] ..... B41J 2/17
(52) U.S. Cl. ..... 347/84
(58) Field of Search ..... 347/84–87

(56) References Cited

U.S. PATENT DOCUMENTS

| | | | | | |
|---|---|---|---|---|---|
| 4,771,295 | A | | 9/1988 | Baker et al. | |
| 4,831,389 | A | | 5/1989 | Chan | |
| 5,489,931 | A | | 2/1996 | Shibata et al. | |
| 5,537,134 | A | * | 7/1996 | Baldwin et al. | 347/85 |
| 5,561,453 | A | | 10/1996 | Shibata et al. | |
| 5,691,754 | A | | 11/1997 | Ta | |
| 5,988,801 | A | * | 11/1999 | Coiner | 347/85 |

* cited by examiner

*Primary Examiner*—Judy Nguyen

(57) ABSTRACT

A fluid transport conduit for conveying ink-jet ink from a reservoir to a printhead in an ink-jet printer is provided. The fluid transport conduit comprises at least one inner layer, such as high density polyethylene, cyclic olefin copolymer, or polypropylene homopolymer, that is flexible and is a barrier to liquids, and at least one outer layer, such as nylon or polyvinyl alcohol, that is a barrier to air and is softer, or more compliant, than the inner layer, with the inner layer bonded to the outer layer. The two layers are advantageously co-extruded to form the fluid transport conduit.

11 Claims, 1 Drawing Sheet

CO-EXTRUDED TUBING FOR AN OFF-AXIS INK DELIVERY SYSTEM

TECHNICAL FIELD

The present invention is directed to ink-jet printers and, more particularly, to ink-jet printers employing an off-axis ink delivery system for replenishing on-axis print cartridges with ink.

BACKGROUND ART

In a conventional ink jet printer, ink is deposited on record media such as paper via a disposable pen, the pen being mounted on a carriage for reciprocation across the paper's face. Ink is ejected through the pen's printhead, the printhead being connected to a volume of ink which is stored in a reservoir onboard the pen. When the ink reservoir is depleted, the pen is removed from the carriage, discarded, and replaced with a new pen. An example of such a pen is disclosed in U.S. Pat. No. 4,771,295, which is entitled "Thermal Ink Jet Pen Body Construction Having Improved Ink Storage and Feed Capability", and which is commonly owned herewith. The disclosure of that patent is incorporated herein by this reference.

In order to extend the useful life of ink jet pens, several off-axis ink supply approaches have been suggested whereby the pen's onboard ink reservoir is refilled. These approaches have included the use of a second, off-board ink supply, generally in the form of a larger ink reservoir positioned at a location which is remote from the pen. As the pen's onboard supply of ink is depleted, substitute ink is delivered from the off-board reservoir through an arrangement of one or more tubes. The larger ink reservoir thus allows for use of the pen beyond the duration of the its onboard ink supply, effectively extending the pen's lifetime to coincide with the lifetime of the its associated printhead. An illustrative example of such an approach is provided in U.S. Pat. No. 4,831,389, which is entitled "Off Board Ink Supply System and Process for Operating an Ink Jet Printer", and which is commonly owned herewith. The disclosure of that patent is incorporated herein by this reference.

Although known off-axis ink supply approaches generally have been effective in extending the lifetime of a printer's pen, there remains room for improvement, particularly in the manner by which ink is delivered to the pen. In the past, ink has been delivered via flexible tubing which runs from the off-board ink supply to the reservoir within the pen. The tubing generally extends as a linear segment, each tube having a length which allows for reciprocation of the pen. As the pen reciprocates, and the distance between the pen and off-board reservoir changes, the tubing is bent over on itself so as to take up the resulting slack.

This tubing arrangement has led to a number of problems, due in large part, to the effects of tube bending during reciprocation of the pen. Such bending, for example, will often produce an unacceptably high stress on the tube, increasing tube fatigue, and correspondingly decreasing the lifetime of the tube. In addition, bending of the tubes may result in an undesirably high torque on the pen carriage, increasing the power required to drive the pen. Further, because the bending of tubes requires a significant amount of clearance, the use of off-axis ink supplies has resulted in a significant increase in the printer's size. The latter problem is particularly troublesome where a multi-color pen is employed, it being necessary to run a plurality of tubes (one for each color) between the reservoir and the reciprocating pen.

In spite of the foregoing, other solutions, such as the use of a rigid tube, as disclosed, for example, in commonly-owned U.S. Pat. No. 5,691,754, entitled "Rigid Tube Off-Axis Ink Supply", do not offer the potential advantages provided by flexible tubing, or conduit. Specifically, flexible conduit permits more facile movement of the print heads.

In addition to the foregoing, the conduit must also contain and deliver ink under various environmental conditions and usages. The conduit must balance the following requirements:

- the conduit must be sized large enough to deliver the required amount of ink flow;
- stiffness must not affect carriage dynamics, or pen seating;
- bend diameters must be kept to a minimum for product size/layout;
- the conduit must withstand five years of carriage cycles;
- the conduit must maintain properties over shipping and operating temperatures;
- the conduit must be able to withstand chemical attack from inks or other outside contaminants;
- the conduit must be able to contain ink without letting air diffuse in or water vapor diffuse out;
- the conduit must be able to bend in small arcs for routing in the product without kinking; and
- the conduit must be consistently processable and cost effective.

Defining a material is challenging because several of these requirements pull material properties in opposite directions. Work on tubing solutions has been on-going for the past several years and has resulted in a number of solutions, but none have been totally satisfactory to date. The technologies and materials that have been available are limited and the products have had to make large sacrifices. One printer product was released with a Teflon-based material (polychlorotrifluoroethylene; PCTFE), which had fatigue issues, and then was changed to another Teflon-type material (fluorinated ethylene propylene; FEP), which had processing and diffusion issues. Another printer product started with Saran, which is polyvinylidene dichloride, which had processing and fatigue issues, and then was changed to low density polyethylene, which was a compromise to diffusion. The available options for materials that adequately satisfy the above-listed design requirements have, for the most part, been exhausted.

Thus, there remains a need for a fluid transport conduit that allows design freedom while using the existing material base and is impermeable to air and ink while retaining bending flexibility.

DISCLOSURE OF INVENTION

In accordance with the present invention, a fluid transport conduit for conveying ink-jet ink from a reservoir to a printhead is provided. The fluid transport conduit comprises an inner layer that is flexible and comprises a barrier to liquid and an outer layer that is a barrier to air and is more compliant than the inner layer, with the inner layer bonded to the outer layer.

Depending on the materials used for the inner layer and the outer layer, an adhesive may be used to bond the two layers together. Alternatively, the inner and outer layers may be bonded together naturally by a co-extrusion process. Further, either or both of the inner layer and outer layer may include more than one material for further tailoring the properties of the conduit.

Employing an inner layer that is flexible and is a barrier to liquid and an outer layer that is more compliant than the inner layer and is a barrier to air results in a fluid transport conduit that is flexible during movement of the printhead, yet protects the ink from the effects of air, while preventing leakage of ink into the printer.

BEST MODES FOR CARRYING OUT THE INVENTION

Figure 1:
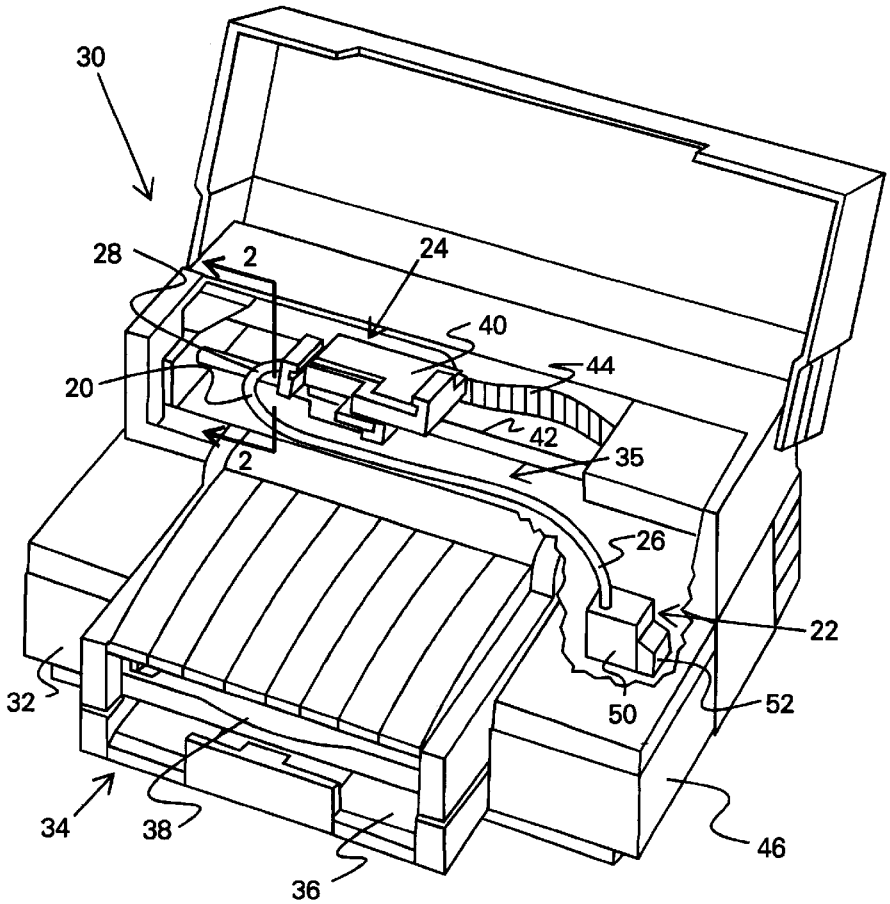
FIG. 1 (prior art)
FIG. 1 depicts a conventional off-axis ink-jet printer, showing a fluid transport conduit for conveying ink from a reservoir to a printhead, wherein unlike earlier ink-jet printers, only the printhead is mounted on the print axis, and the reservoir is located off-axis, in a stationary location.

FIG. 1 illustrates an embodiment of a flexible conduit 20, constructed in accordance with the present invention, which may be used to convey or transport a fluid therethrough from a first location 22 to a second location 24. The conduit or tube 20 has a first end 26 for receiving fluid at the first location 22, and a second end 28 for delivering fluid to the second location 26. It is apparent that the conduit system 20 may be used in a variety of different applications requiring a flexible conduit to couple together two remote locations. In particular, the conduit 20 is well suited for applications having the two locations 22, 24 moving relative to one another. For example, the conduit 20 may be useful in hydraulic applications, or various robotic applications requiring fluid conveyance, such as chemical sprays, paint sprays, coolant or lubricating systems, and the like.

One particularly useful implementation for discussing the characteristics of conduit is an ink jet printing mechanism, here illustrated as an ink jet printer assembly such as depicted in U.S. Pat. No. 5,561,453, assigned to the same assignee as the present application. While it is apparent that the printing mechanism components may vary from model to model, the illustrated ink jet printer 30 has a chassis 32 and a print media handling system 34. The media handling system 34 includes a feed tray 36 for supplying a print medium (not shown), such as paper, card stock, transparencies, mylar, foils, etc., to the printer 30. The media handling system 34 has a series of rollers (not shown) for delivering the sheets from the feed tray 36, into a print zone 35, and then into an output tray 38.

In the illustrated embodiment, the second location 24 comprises a printhead and carriage assembly 40 which may be driven from side to side across the print zone 35 along a guide rod 42 by, for example, by a conventional drive belt/pulley and motor assembly (not shown). The printhead 40 may include a series of nozzles constructed in a conventional manner to selectively deposit one or more ink droplets on the print medium in accordance with instructions received via a conductor strip 44 from a printer controller 46, located within chassis 32, for instance at the location shown in FIG. 1. The controller 46 generally receives instructions from a computer (not shown), such as a personal computer. Personal computers, their input devices such as a keyboard and/or a mouse device (not shown), and computer monitors are all well known to those skilled in the art. In the illustrated embodiment, the first fluid location 22 comprises an ink reservoir 50 which stores a supply of ink. A variety of different systems may be implemented to propel the ink from the reservoir 50 to the printhead 40. For example, a piston actuator assembly 52 extends into the reservoir 50 to force ink into the conduit first end 26. Other methods of urging the ink through tube 20 include the use of capillary action, a gravity feed system provided by mounting the reservoir 50 at a location (not shown) higher than the printhead 40, or pumping action, for instance provided by a peristaltic pump (not shown).

As the printhead 40 is propelled back and forth across the print zone 35, it is apparent that the conduit 20 must flex and bend as the second end 28 moves with the printhead relative to the stationary first end 26 at reservoir 50. There are limitations to the degree of bending that a tube can withstand before collapsing. These limitations depend upon the type of material selected and the cross-sectional profile of the particular tube. The conduit 20 may be constructed from a variety of different elastomers and plastics, with varying material properties.

Figure 2:
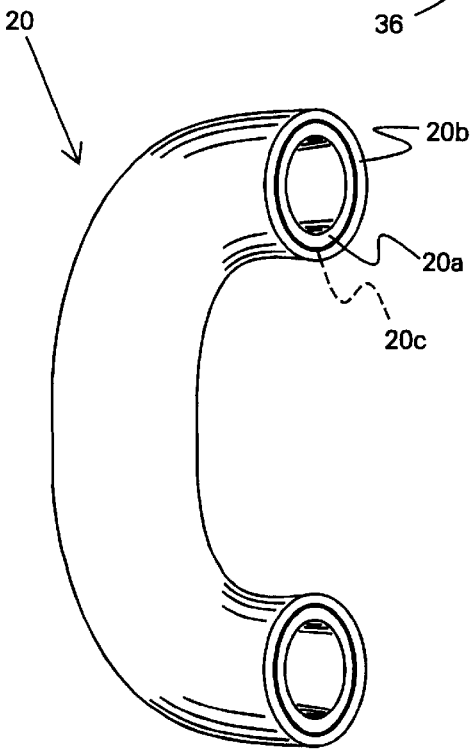
FIG. 2 is an enlarged sectional perspective view taken along the line 2—2 of FIG. 1, depicting the fluid transport conduit comprising at least two layers, suitable for transporting the ink and protecting the ink from the environment, while protecting the printer against ink leakage through the conduit wall.

In accordance with the present invention, the conduit 20 comprises a plurality of layers of different materials, beginning with an innermost layer 20*a* and terminated with an outermost layer 20*b*, as depicted in FIG. 2. The layers 20*a*, 20*b* may be bonded together with an adhesive layer 20*c*.

The innermost layer 20*a* comprises a material that forms a liquid barrier and prevents leakage of ink. Examples of such materials include polyethylene, high density polyethylene, and polypropylene homo-polymer.

The outermost layer 20*b* comprises a material that forms a barrier against the atmosphere (air) and prevents reaction of gaseous components in the air, e.g., oxygen and water vapor, with the ink. The outermost layer 20*b* is ordinarily stiff, but flexibility is required. Therefore, fatigue-resistant materials are desired; that is, a relatively more compliant material should be used as the outermost layer 20*b* to reduce fatigue. Examples include nylon, linear low density polyethylene, polypropylene co-polymer, and, and poly (vinyl alcohol).

The adhesive layer 20*c* is optional, and its use depends on the particular materials used for layers 20*a*, 20*b*. Examples include (1) low density polyethylene reacted with peroxides and then maleic anhydride, also known as maleic anhydride modified polyethylene (co-extrudable adhesive resin—polyolefin-based adhesive), available as Bynel adhesive from E.I. du Pont de Nemours & Co., and (2) polyvinyl-based adhesives, including polyvinyl acetate.

While there is a plurality of individual layer properties and their individual primary utilities, each layer combines to contribute to:

- the overall composite air barrier and water vapor barrier, the overall composite stiffness,
- the overall composite structural robustness without kinking the conduit wall,
- and the overall fatigue resistance.

To this end, each layer must have complimentary material properties.

The layers can have a wide range of thicknesses. Layers can be as thin as 5% to 95% of the total wall thickness. Absolute thicknesses can range from 0.02 mm to 3 mm or more. Overall performance of the conduit is dictated by the proportion of individual materials present in the construction. Examples of common ratios of the inner/outer layer thicknesses include, but are not limited to, 30/70, 40/60, 50/50, 60/40 and 70/30.

The inside diameter is in the range of about 1 to 5 mm, while the outside diameter is in the range of about 1.5 to 9 mm.

While two layers 20*a*, 20*b* bonded together with an adhesive layer are shown, it will be appreciated that additional layers may be employed in the practice of the present invention. The constraint imposed is that the further out from the center of the conduit 20, the more compliant the material employed, such that the innermost layer 20*a* is stiffer than the outermost layer 20*b*.

The conduit 20 is conveniently prepared by co-extrusion. The co-extrusion technology involves the extrusion of tube structures that are comprised of multiple layers of different materials. Structures with multiple materials are much more versatile in that the different layers can satisfy different functional needs. This expands the options for materials because there are less requirements asked of a given individual material. For example, a material that is a good barrier to water and air, but has poor fatigue resistance, such as nylon, may be combined with a material that is a poor barrier to water and air, but has good fatigue resistance, such as a polyolefin.

Many materials were either extruded alone or co-extruded with other materials. The material candidates included homogeneous plastic materials, as well as blends of homogeneous plastic materials. Specific raw plastic material grades and their manufacturers were analyzed, specified, prototyped and tested. Some combinations were supplied by one extruder vendor, while other combinations were supplied by a second extruder vendor. Many of the same combinations were supplied by both suppliers; this raises the issue of the grade consistency of the polymers, discussed below.

The selection of the materials and grades is key to taking full advantage of the benefits and capabilities of the co-extrusion technology. Modeling techniques have been developed to simulate tradeoffs of barrier performance and stiffness between different material combinations within a single construction. Modeling was useful in determining the appropriate thickness ratios for a given set of materials.

The preferred structure is an inner layer of polyethylene, preferably high density polyethylene, a middle bonding layer, preferably Bynel, and an outer layer of nylon, preferably nylon 12. All three materials are of the same material family that are common and well understood. This material combination is the best balance of all processing and functional parameters.

The inner high density polyethylene layer is excellent for material compatibility and serves as a good water barrier. The nylon outer layer is a good air barrier material. The adhesive (Bynel) layer is used to bond the two layers together. All three materials are good for fatigue. The high density polyethylene material is difficult to process separately, but when combined into a co-extrusion structure with nylon, it processes well. The total package has resulted in elegant solutions for off-axis printers and plotter.

Other material sets that may be suitably employed in the practice of the present invention include: (1) inner and outer layers are both polyolefins, with the inner layer comprising, e.g., high density polyethylene (HDPE) and the outer layer comprising, e.g., linear low density PE (LLDPE); (2) inner layer is polyolefin and outer layer is nylon; (3) inner and outer layers are both polypropylenes, with the inner layer comprising, e.g., homopolymer polypropylene (PP) and the outer layer comprising, e.g., polypropylene co-polymer (PP+PE co-polymerized together; 95/5); and (4) inner layer is a polyolefin, e.g., HDPE and the outer layer is a polyvinyl derivative, e.g., polyvinyl alcohol (PVA, or ethylene vinyl alcohol, EVOH).

In accordance with an additional embodiment of the present invention, a method for determining the quality of a co-extruded tube is provided. For one class of tubes, it was determined that the qualification technique for determining layer thickness at the vendor was not satisfactory. The existing method was to carefully cut the tubing in cross-section and to observe the layers under a microscope. This method did not work well with these tubes because the cutting action and/or the reflectance off the surfaces gave false indications of where the layer edges started and ended.

In this additional embodiment of the present invention, a tint was provided to the center (adhesive) layer, using a non-reactive dye. The tint was high enough such that the end-view layer would have contrast but viewed from the outside, the dye would not be obvious. This method works well because the effects of cutting do not interfere with the layer thickness measurement.

While the foregoing description has been given in terms of two layers, preferably adhered together with a third layers, it will be appreciated by those skilled in this art that the invention broadly covers additional layers.

INDUSTRIAL APPLICABILITY

The co-extruded fluid transport conduit is expected to find use in many off-axis ink jet printers and plotters, in which only the ink printhead is moved across the print medium and the ink reservoir is located off the axis of printing. Additional applicability is expected to find use in non-moving ink printhead printers and plotters.

What is claimed is:

1. A fluid transport conduit for conveying ink-jet ink from a reservoir to a printhead comprising an inner layer and an outer layer, with said inner layer bonded to said outer layer, wherein (a) said inner layer is stiffer than said outer layer, comprises a barrier to a liquid, and comprises high density polyethylene, and wherein (b) said outer layer is a barrier to air, is more compliant than said inner layer, and comprises nylon.

2. The fluid transport conduit of claim 1 wherein an adhesive is used to bond said inner layer to said outer layer.

3. The fluid transport conduit of claim 1 comprising said inner layer of high density polyethylene and said outer layer of nylon, bonded together with a polyolefin-based adhesive consisting essentially of low density polyethylene reacted with peroxides and then maleic anhydride.

4. The fluid transport conduit of claim 2 wherein said adhesive is selected from the group consisting of polyolefin-based adhesives and polyvinyl-based adhesives.

5. The fluid transport conduit of claim 4 wherein said polyolefin-based adhesive consists essentially of low density polyethylene reacted with peroxides and then maleic anhydride.

6. The fluid transport conduit of claim 4 wherein said polyvinyl-based adhesive consists essentially of polyvinyl acetate.

7. A co-extruded fluid transport conduit for conveying ink-jet ink from a reservoir to a printhead comprising an inner layer and an outer layer, with said inner layer bonded to said outer layer, wherein (a) said inner layer is stiffer than said outer layer, comprises a barrier to a liquid, and comprises high density polyethylene, and wherein (b) said outer layer is a barrier to air, is more compliant than said inner layer, and comprises nylon.

8. The fluid transport conduit of claim 7 wherein an adhesive is used to bond said inner layer to said outer layer.

9. The fluid transport conduit of claim 7 comprising said inner layer of high density polyethylene and said outer layer of nylon, bonded together with a polyolefin-based adhesive consisting essentially of low density polyethylene reacted with peroxides and then maleic anhydride.

10. The fluid transport conduit of claim 8 wherein said adhesive is selected from the group consisting of polyolefin-based adhesives and polyvinyl-based adhesives.

11. The fluid transport conduit of claim 10 wherein said polyolefin-based adhesive consists essentially of low density polyethylene reacted with peroxides and then maleic anhydride.

* * * * *